US008383526B2

(12) United States Patent
Miyagoshi et al.

(10) Patent No.: US 8,383,526 B2
(45) Date of Patent: Feb. 26, 2013

(54) SHEET FOR TOTAL HEAT EXCHANGER

(75) Inventors: Fumio Miyagoshi, Echizen (JP); Masao Fujita, Echizen (JP); Hidenao Saito, Echizen (JP); Hirokuni Tajima, Echizen (JP); Sadao Odajima, Kadoma (JP)

(73) Assignees: Rengo Co., Ltd., Osaka (JP); Frontier Industrial Co., Ltd., Osaka (JP)

( * ) Notice: Subject to any disclaimer, the term of this patent is extended or adjusted under 35 U.S.C. 154(b) by 489 days.

(21) Appl. No.: 12/224,779

(22) PCT Filed: Jun. 4, 2007

(86) PCT No.: PCT/JP2007/061679

§ 371 (c)(1),
(2), (4) Date: Nov. 10, 2008

(87) PCT Pub. No.: WO2007/142344

PCT Pub. Date: Dec. 13, 2007

(65) Prior Publication Data

US 2009/0068437 A1 Mar. 12, 2009

(30) Foreign Application Priority Data

Jun. 5, 2006 (JP) ..... 2006-156440
May 16, 2007 (JP) ..... 2007-130852

(51) Int. Cl.
*B32B 9/06* (2006.01)

(52) U.S. Cl. ..... 442/59; 442/86; 442/136; 442/153; 442/166; 428/920; 428/921

(58) Field of Classification Search ..... 442/59, 442/86, 136, 153, 166; 428/920, 921
See application file for complete search history.

(56) References Cited

U.S. PATENT DOCUMENTS

| | | | | |
|---|---|---|---|---|
| 3,840,395 | A * | 10/1974 | Koch | 106/203.2 |
| 5,219,910 | A * | 6/1993 | Stahl et al. | 524/236 |
| 2003/0094269 | A1 | 5/2003 | Arai et al. | |
| 2010/0015299 | A1 * | 1/2010 | Borst et al. | 426/106 |

FOREIGN PATENT DOCUMENTS

| | | | |
|---|---|---|---|
| EP | 0 661 502 | | 7/1995 |
| JP | 61-46899 | | 3/1986 |
| JP | 7-133994 | | 5/1995 |
| JP | 8-219504 | | 8/1996 |
| JP | 9-47654 | | 2/1997 |
| JP | 2639303 | | 4/1997 |
| JP | 2003-148892 | | 5/2003 |
| JP | 2003128977 | A * | 5/2003 |
| WO | WO 2006119880 | A1 * | 11/2006 |

OTHER PUBLICATIONS

International Search Report issued Jul. 17, 2007 in the International (PCT) Application PCT/JP2007/061679 of which the present application is the U.S. National Stage.

* cited by examiner

*Primary Examiner* — Elizabeth Cole
(74) *Attorney, Agent, or Firm* — Wenderoth, Lind & Ponack, L.L.P.

(57) ABSTRACT

A liquid containing a hydrophilic polymer is applied by spreading or impregnation to a porous sheet comprising paper or a nonwoven fabric containing not less than 30% by weight and not more than 100% by weight of hydrophilic fiber to provide a hydrophilic polymer-processed sheet of which the surface and/or the interior of the porous sheet is filled with the hydrophilic polymer, which is made insoluble to water. This sheet is used as a sheet for a total heat exchanger which has higher conductivity of sensible heat and latent heat than conventional sheet for a total heat exchanger that uses a moisture permeable membrane.

4 Claims, 7 Drawing Sheets

SHEET FOR TOTAL HEAT EXCHANGER

TECHNICAL FIELD

This invention relates to a sheet used in a total heat exchanger.

BACKGROUND ART

Today, sick house syndrome is becoming a big problem, in which people feel pains in the eyes and throat, and feel dizzy or get sick when they are indoors. This syndrome is considered to be caused by volatile organic compounds released from building materials, furniture and other daily necessities. One of the reasons why this disease is becoming a big problem is because today's buildings are highly airtight, and due to more frequent use of air-conditioners, interior air is less frequently exchanged, so that volatilized organic compounds tend to remain indoors for a prolonged period of time. In order to cope with this problem, the recently revised Building Standard Acts require the provision of ventilating facilities in every building. Many of today's home air-conditioners are also equipped with ventilating functions to promote ventilation in buildings.

But too much ventilation makes it more difficult to maintain the desired temperature by heating or cooling with minimum energy consumption. For this reason, total heat exchangers are gathering much attention, which can exchange air with minimum release of heat or cold air to the outside, thereby reducing energy consumption.

Such total heat exchangers include a rotary total heat exchanger which transfers heat of exhaust air to intake air by the rotation of a moisture-absorbing rotor, and a static total heat exchanger as shown in FIG. 3. Such a static total heat exchanger includes corrugated total heat exchanger elements 3 having gas barrier properties. When outer fresh supply air 1 and inner polluted exhaust air 2 pass through separate paths in the elements 3, sensible heat is transferred from the exhaust air 2 to the supply air 1. Also, since moisture can penetrate through the elements 3, the latent heat possessed by the water contained in the exhaust air 2 is also transferred to the supply air 1. Thus, it is possible to minimize the release of heat or cold to the outside.

For higher efficiency of heat exchange, the total heat exchanger sheets used for the total heat exchanger elements 3 in such a static total heat exchanger is preferably made of a material which allows permeation of not only sensible heat but moisture and thus latent heat. Such sheets include total heat exchanger sheets using e.g. Japanese paper (Washi), fireproof paper made of pulp, glass fiber-mixed paper or inorganic powder-containing paper. But because ordinary paper allows permeation of air too, sheets having a moisture permeable membrane are frequently used. Such sheets include a hybrid moisture permeable membrane described in examples of Patent document 1, which comprises a porous sheet made of polyethylene or polytetrafluoroethylene, and a moisture-permeable water-insoluble hydrophilic polymer membrane formed on one side of the porous sheet.

[Patent document 1] JP Patent 2639303

DISCLOSURE OF THE INVENTION

Object of the Invention

But if a moisture permeable membrane is formed by coating on a sheet made e.g. of polyethylene, as disclosed in Patent document 1, due to the resistance to heat conduction of the membrane itself, efficiency of sensible heat conduction decreases. Also, such a moisture permeable membrane is actually not very high in moisture permeability, so that moisture cannot sufficiently permeate therethrough. Thus, this membrane cannot sufficiently improve the efficiency of latent heat conduction, either. Also, as described in paragraph [0008] of Patent document 1, if a water-insoluble hydrophilic polymer is applied directly to e.g. a nonwoven fabric, such a membrane tends to be too thick. If its thickness is reduced, pin holes tend to develop.

An object of this invention is therefore to provide a sheet for use in a total heat exchanger which is higher in the efficiency of sensible heat conduction and latent heat conduction than conventional total heat exchanger sheets using a moisture permeable membrane.

Means to Achieve the Object

According to the present invention, this object is achieved by using, as a sheet for a total heat exchanger, a hydrophilic polymer-processed sheet comprising a porous sheet, such as paper, nonwoven fabric or woven fabric, containing not less than 30% by weight and not more than 100% by weight of hydrophilic fiber, and coated with or soaked in an aqueous solution containing a hydrophilic polymer, the hydrophilic polymer being made water-insoluble on the surface and/or inside of the porous sheet, thereby closing pores of the porous sheet.

Because the porous sheet, which contains not less than 30% by weight of hydrophilic fiber, has high affinity for the hydrophilic polymer, pin holes are less likely to develop in a film formed on the substrate by applying the hydrophilic polymer and making the polymer insoluble to water. Alternatively, it is also possible to immerse the porous sheet in an aqueous solution of a hydrophilic polymer, and then solidify the hydrophilic polymer in the sheet, thereby filling the pores in the substrate without forming a film. By combining the hydrophilic fiber and the hydrophilic polymer in the above-described manner, it is possible to close the pores of the porous sheet without forming a thick film. When moisture permeates through this thin hydrophilic polymer wall, latent heat also permeates therethrough. Because this wall is sufficiently thin, sensible heat can also fairly freely permeate therethrough. Thus, this sheet has a sufficiently high capacity of heat exchange as a sheet for a total heat exchanger.

Advantages of the Invention

In the total heat exchanger sheet according to this invention, because both the fiber and the polymer are hydrophilic and are entwined together, it is possible to reduce the possibility of delamination without the need to use an adhesive. This in turn reduces the possibility of deterioration in total heat exchange efficiency due to delamination. Because it is possible to minimize the amount of the hydrophilic polymer which closes the pores of the porous sheet, and because the basic physical properties of this sheet is determined by the physical properties of the porous sheet, it is possible to freely adjust its physical properties such as water resistance and mechanical strength by selecting a suitable porous sheet. Further, by using this sheet as a sheet for a total heat exchanger, it is possible to improve the thermal conductivity of the heat exchanger, thereby improving the thermal efficiency of the total heat exchanger. Particularly when cellulose regenerated from a viscose is used as the hydrophilic polymer, the hydrophilic polymer-processed sheet obtained has an extremely high moisture permeability, so that by using this sheet as a sheet for a total heat exchanger, it is possible to greatly improve the moisture exchange efficiency and the total heat exchange efficiency.

DESCRIPTION OF NUMERALS

Figure 1A:
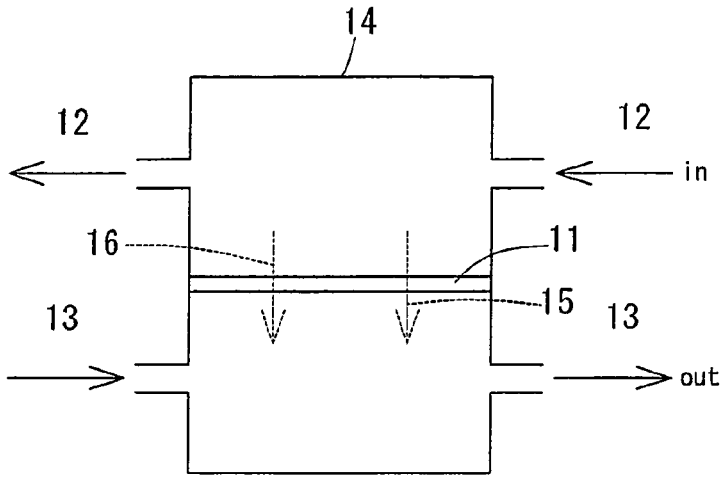
FIG. 1(*a*)-1(*c*) schematically show how a total heat exchanger using a sheet for a total heat exchanger according to the present invention operates.

1. Supply air
2. Exhaust air
3. Element for total heat exchanger
11. Sheet for total heat exchanger
12. Supply gas
13. Exhaust gas
14. Element for total heat exchanger
15. Sensible heat
16. Moisture
21. Air supply fan
22. Exhaust fan

BEST MODE FOR EMBODYING THE INVENTION

The present invention is now described in detail.

This invention relates to a sheet for use in a total heat exchanger comprising a hydrophilic polymer-processed sheet including a porous sheet coated with or impregnated with an aqueous solution of a hydrophilic polymer. The sheet for use in a total heat exchanger refers to a sheet used in a total heat exchanger for heat exchange.

The porous sheet is a sheet made of pulp or synthetic fiber and having fine pores, such as paper, nonwoven fabric or woven fabric. Among them, paper or nonwoven fabric is preferably because they are easy to process and inexpensive.

The porous sheet has to contain not less than 30% by weight of hydrophilic fiber such as wood pulp, rayon, cotton or hemp, which all comprise cellulose, wool, cellulose acetate, which is a cellulose derivative, vinylon or polyvinyl alcohol fiber, which both comprise polyvinyl alcohol (abbreviated to "PVA"), or glass fiber, which comprises an inorganic material. The content of hydrophilic fiber is preferably not less than 50% by weight. If its content is less than 30% by weight, affinity for hydrophilic polymer is insufficient, so that the coated hydrophilic polymer may peel off, or the aqueous solution containing the hydrophilic polymer may not spread uniformly and be distributed in lumps on the sheet. For wettability, the content of the hydrophilic fiber is as high as possible, and is most preferably 100% by weight. As components other than the hydrophilic fiber, the porous sheet may contain polyethylene fiber, propylene fiber and other fibers to change the appearance or the texture, or to increase the strength. But the porous sheet must not be impregnated with any resin that could close its pores.

In the case of paper or wet nonwoven fabric, two or more layers comprising fibers dispersed in water may be joined together during wetting. The respective layers may have different compositions from each other e.g. to increase the strength. But the surface layer on which the aqueous solution of the hydrophilic polymer is applied has to contain hydrophilic fiber by not less than 30% by weight. For example, if two-layer paper of which the respective layers are formed by mixing hydrophilic fiber and non-hydrophilic fiber is used as the porous sheet, by changing the hydrophilic fiber contents of the respective layers from each other, and applying the hydrophilic polymer on the layer of which the hydrophilic fiber content is greater, because a larger portion of the hydrophilic polymer is distributed on the layer of which the hydrophilic fiber content is greater, it is possible to close the pores of the porous sheet with a smaller coating amount.

Specific porous sheets include a nonwoven fabric formed by mixing polyethylene fiber and rayon fiber, paper formed by mixing wood pulp and Manila hemp, and kraft paper. Here, the hydrophilic fibers in the respective sheets are rayon fiber, wood pulp and Manila hemp, and wood fiber. Among these sheets, by using a porous sheet of which one side is calendered, such as one-side-polished kraft paper, it is possible to close the pores of the porous sheet with a smaller amount of hydrophilic polymer. As with paper formed by mixing wood pulp and Manila hemp, the porous sheet may contain a plurality of kinds of hydrophilic fibers. Also, the porous sheet may contain a plurality of kinds of non-hydrophilic fibers.

This porous sheet is coated with an aqueous solution containing a hydrophilic polymer. Such an aqueous solution may be an aqueous solution of cellulose such as a viscose and a cellulose-copper-ammonia solution, or aqueous solution of polyvinyl alcohol, or aqueous acetic acid solution of chitosan as a hydrophilic polymer.

The solution used preferably has a concentration of not less than 1.0% by weight, more preferably not less than 2.0% by weight. If its concentration is less than 1.0% by weight, since the coating amount is too small, it may be difficult to completely close the pores of the porous sheet. On the other hand, its concentration is preferably not more than 30% by weight, more preferably not more than 10% by weight. If over 30% by weight, the viscosity of the solution tends to be so high that handling is difficult. Moreover, the hydrophilic polymer tends to be deposited in a more than necessary amount. Thus, in some cases, the hydrophilic polymer may form a layer, which may then peel off.

This aqueous solution may be applied to the porous sheet by coating and impregnation. Specifically, the porous sheet may be immersed in the aqueous solution, the porous sheet may be brought into contact with a roller wetted with the aqueous solution, or after bringing the sheet into contact with the roller, the roller may be pressed against the sheet to squeeze the sheet, thereby wetting the entire porous sheet with the aqueous solution. Since a major portion of the porous sheet is hydrophilic fiber, the aqueous solution is never repelled but can uniformly wet and cover the surface of the sheet.

The coating amount of the hydrophilic polymer on the sheet is preferably not less than 0.5 $g/m^2$, more preferably not less than 1.0 $g/m^2$. If this amount is less than 0.5 $g/m^2$, the hydrophilic polymer is too small in amount to completely close the pores of the porous sheet. Thus, some pores may remain unclosed. On the other hand, the coating amount is preferably not more than 30 $g/m^2$, more preferably not more than 10 $g/m^2$. If over 30 $g/m^2$, the coating amount is so large that the film formed on the surface tends to be too thick. The coating amount is the amount per unit area of the hydrophilic polymer which is deposited in the form of a sheet by being made insoluble to water after the aqueous solution of the hydrophilic polymer has been applied to the sheet.

From the thus coated aqueous solution, a film is formed that covers the entire coating surface of the porous sheet by reacting the solution with an acid, thereby regenerating cellulose, if the solution is a viscose, or by adding a cross-linking agent to the solution and heating and reacting it, if the solution is PVA, thereby making the hydrophilic polymer insoluble to water. Thus, a hydrophilic polymer-processed sheet is obtained of which the porous sheet has its pores closed. In another method, the viscose or PVA is permeated into the inner pores of the porous sheet, and the hydrophilic polymer is made insoluble to water on the surface or inside of the porous sheet, thereby obtaining a hydrophilic polymer-processed sheet of which the porous sheet has its pores closed. If the solution is applied by spreading only, the coated surface tends to be covered by a film. If the solution is applied by impregnation, the hydrophilic polymer tends to solidify in the pores, thereby closing the pores. If a film is formed, because the film is made of a hydrophilic polymer, its affinity for the porous sheet, which contains not less than 30% by weight of hydrophilic fiber, is high, so that the film can cover the sheet without the need for adhesive.

If a viscose is used as the hydrophilic polymer, by treating the porous sheet with an aqueous solution of sulfuric acid after applying the viscose, thereby regenerating cellulose from the viscose, it is possible to obtain a hydrophilic polymer-processed sheet of which the porous sheet has its pores closed with the regenerated cellulose. As a specific method of this treatment, a hydrophilic polymer-processed sheet impregnated with a viscose may be continuously immersed in an aqueous solution of sulfuric acid. In order to remove reaction by-products after regeneration of the cellulose, desulfurization with an aqueous solution of sodium sulfide or bleaching with an aqueous solution of sodium hypochlorite may be carried out.

If PVA is used as the hydrophilic polymer, by applying an aqueous solution in which PVA having reactive functional groups such as carbonyl groups and a cross-linking agent are mixed together to the porous sheet, and then heating and drying it, thereby making the solution insoluble to water by reacting PVA with the cross-linking agent, it is possible to obtain a hydrophilic polymer-processed sheet of which the porous sheet has its pores closed.

In the thus obtained hydrophilic polymer-processed sheet, the pores present in the original porous sheet are closed by the film or by the solution in the pores. This prevents passing of gas through the sheet, so that this sheet can be used in a total heat exchanger as a partition for preventing gases of different temperatures from mixing together. The pores are closed by a thin film or masses of the penetrated hydrophilic polymer, sensible heat can be easily transmitted therethrough. Also, because the hydrophilic polymer is hydrophilic, moisture can easily pass therethrough, so that latent heat, which is carried by moisture, can also easily penetrate therethrough.

Thus, because it is possible to transmit latent heat and sensible heat with sufficient efficiency, and to prevent mixing of air, the hydrophilic polymer-processed sheet according to this invention is suitable as a sheet for use in a total heat exchanger.

Preferably, the sheet for use in a total heat exchanger according to this invention is subjected to fireproof treatment. Particularly if the sheet according to the invention is used in a total heat exchanger provided in a building, it has preferably fire retardance that passes Level 3 flameproofness in "Test Method for Fire Retardance of Thin Construction Materials" under JIS A 1322. More preferably, it has fire retardance that passes Level 2 or Level 1 flameproofness.

The fireproof treatment may be carried out by applying a fire retardant to the hydrophilic polymer-processed sheet. Specifically, a fire retardant may be spread or sprayed on the surface of the hydrophilic polymer-processed sheet coated with the hydrophilic polymer, the hydrophilic polymer-processed sheet may be immersed in a fire retardant solution, or the sheet may be processed using a hydrophilic polymer liquid in which a fire retardant is mixed beforehand. Also, if a viscose is used as the hydrophilic polymer, fireproof treatment may be carried out after treatment with an aqueous solution of sulfuric acid, before e.g. drying.

Fire retardants usable in this invention include inorganic fire retardants, inorganic phosphorus retardants, nitrogen-containing compounds, chlorine compounds and bromine compounds. Specifically, the fire retardant may be an aqueous solution of a mixture of borax and boric acid, aluminum hydroxide, antimony trioxide, ammonium phosphate, ammonium polyphosphate, ammonium amidosulfate, guanidine amidosulfate, guanidine phosphate, phosphoric amide, chlorinated polyolefin, ammonium bromide, or a non-ether polybromo cyclic compound, or a water-dispersible fire retardant. The type and the adhered amount of the fire retardant have to be selected so as not to impair the moisture permeability of the hydrophilic polymer which has been made insoluble to water.

The content of the fire retardant is preferably not less than 2% by weight, more preferably not less than 5% by weight of the sheet for a total heat exchanger. If its content is less than 2% by weight, the fire retardance tends to be insufficient. On the other hand, its content is preferably not more than 70% by weight, more preferably not more than 50% by weight. If the content of the fire retardant is more than 70% by weight, the moisture permeability of hydrophilic polymer-processed sheet may be detrimentally affected. Also, before applying an aqueous solution containing a hydrophilic polymer, a large amount of aluminum hydroxide may be added to the porous sheet when producing the sheet, thereby imparting fire retardance beforehand.

Further, the sheet for use in a total heat exchanger according to the present invention is preferably subjected to waterproof treatment. As specific means for waterproof treatment, a sizing agent or a wet-strength additive may be added when producing the porous sheet before being coated with an aqueous solution containing a hydrophilic polymer, or such waterproof treatment may be carried out at a later stage. But since an aqueous solution containing a hydrophilic polymer is applied, a water-resistant agent is preferably applied to the hydrophilic polymer-processed sheet by spreading or impregnation. Such waterproof treatment is carried out by applying a water-resistant agent such as a fluorine polymer compound, wax emulsion, fatty acid resin, or a mixture thereof to the hydrophilic polymer-processed sheet by spreading or impregnation. Such waterproof treatment may be carried out when producing base paper, or immediately before or after or simultaneously with the fireproof treatment.

Further, in order to improve the total heat exchange capacity, the sheet for use in a total heat exchanger according to this invention is subjected to hygroscopic treatment. As specific means of hygroscopic treatment, a moisture absorbent solution may be spread or sprayed on the hydrophilic polymer-processed sheet, the sheet may be immersed in the moisture absorbent solution, or the sheet may be processed using a hydrophilic polymer liquid in which a moisture absorbent is mixed beforehand. By impregnating the sheet with a moisture absorbent, the moisture permeability of the sheet for a total heat exchanger improves, so that latent heat can be more easily transferred. That is, it is possible to improve the heat exchange capacity.

Moisture absorbents usable for the hygroscopic treatment include inorganic acid salts, organic acid salts, inorganic fillers, polyols, ureas and hygroscopic (water-absorbing) polymers. Such inorganic acid salts include lithium chloride, calcium chloride and magnesium chloride. Such organic acid salts include sodium lactate, calcium lactate and pyrrolidone sodium carbonate. Such inorganic fillers include aluminum hydroxide, calcium carbonate, aluminum silicate, magnesium silicate, talc, clay, zeolite, diatomite, sepiolite, silica gel and charcoal activated. Such polyols include glycerol, ethylene glycol, triethylene glycol and polyglycerin. Such ureas include urea and hydroxyethyl urea. Such polymers include polyaspartic acid, polyacrylic acid, polyglutamic acid, polylysine, alginic acid, carboxymethylcellulose, hydroxyalkylcellulose, and salts and cross-linked products thereof, carrageenan, pectin, gellan gum, agar, xanthan gum, hyaluronic acid, guar gum, gum arabic, starch and cross-linked products their, polyethylene glycol, polypropylene glycol, collagen, acrylonitrile polymer suspension, acrylic acid-starch graft copolymer, vinyl acetate-acrylic acid copolymer suspension, acrylonitrile-starch graft copolymer, acrylic acid-acrylamide graft copolymer, polyvinyl alcohol-maleic anhydride copolymer, polyethylene oxides, isobutylene-maleic anhydride copolymer, and acrylic acid-polysaccharide self-cross-linked polymer. The kind and the deposit amount of the moisture absorbent are selected according the desired moisture permeability. The abovementioned inorganic fillers refer to inorganic minerals and inorganic salts that are used as bulking agents.

Further, the sheet for use in a total heat exchanger according to this invention may contain, besides the abovementioned fire retardants and waterproof agents, other additives to such an extent that they do not hinder the moisture permeability and gas barrier properties required for the sheet for a total heat exchanger. Such additives include triethylene glycol and glycerol, as softeners for softening the sheet for a total heat exchanger, thereby improving workability of the sheet.

The sheet for use in a total heat exchanger according to this invention has preferably a thickness of not more than 100 μm, more preferably not more than 80 μm. If its thickness is over 100 μm, the sheet is so thick that its moisture permeability may become insufficient. On the other hand, its thickness is preferably not less than 15 μm, more preferably not less than 20 μm. If its thickness is less than 15 μm, its strength is insufficient, so that it may be broken during forming or during use.

Specifically, the sheet for use in a total heat exchanger according to this invention has as high as possible a gas barrier property, as measured according to a paper pulp test method under standards determined by Japan Technical Association of the Pulp and Paper Industry (JAPAN TAPPI), within such a range that the physical properties required for the sheet for a total heat exchanger, such as moisture permeability, do not deteriorate. Practically, the gas barrier property is preferably not less than 3000 seconds, more preferably not less than 10000 seconds. If the gas barrier property is lower than 3000 seconds, when the sheet is used in a total heat exchanger, the supply gas and the exhaust gas, which have to be separated from each other, tend to mix together.

The moisture permeability of the sheet for use in a total heat exchanger according to this invention was measured according to the B-2 method of "Test Method for Moisture Permeability of Fiber Materials" under JIS L 1099, with air of 30° C. circulated with the water temperature adjusted to 23° C. The moisture permeation per 24 hours is preferably not less than 5000 g/m$^2$, more preferably not less than 10000 g/m$^2$. If the moisture permeability is less than 5000 g/m$^2$, permeation of moisture may be insufficient, so that heat exchange by the transfer of latent heat of water vapor tends to be insufficient. On the other hand, although the moisture permeability is preferably as high as possible, the moisture permeability exceeding 200000 g/m$^2$ is not practical.

Further, the sheet for use in a total heat exchanger according to this invention preferably has a heat conductivity of not less than 0.005 W/(m·K), more preferably not less than 0.01 W/(m·K). If less than 0.005 W/(m·K), the heat exchange properties are insufficient for use in a total heat exchanger. Although the heat conductivity is preferably as high as possible, from the viewpoint of the structure and material, it is impossible to achieve a heat conductivity exceeding 0.1 W/(m·K). The heat conductivity (K) is calculated based on the following equation (1) from the measured value (W) of heat flow, thickness (D) of the sample, heat transfer area (A) and temperature difference (ΔT).

$$K=W\times D/(A\times\Delta T)$$

The sheet for use in a total heat exchanger according to this invention preferably has a tensile strength of not less than 0.3 kN/m, more preferably not less than 0.5 kN/m. If less than 0.3 kN/m, the strength is insufficient, so that the sheet may rupture. On the other hand, if the tensile strength is higher than 5.0 kN/m, other physical properties of the sheet for a total heat exchanger, such as its workability, may deteriorate.

The sheet for use in a total heat exchanger according to the present invention can, on its own, i.e. without the need to laminate another cardboard or sheet thereon, or without the need to laminate two such sheets through an adhesive, separate two different kinds of gas currents that pass through a total heat exchanger from each other, and also allow heat exchange between the two gas currents. The two different kinds of gas currents refer to gas currents that are different in temperature and/or humidity from each other. Between these two kinds of gas currents, sensible heat is transferred from the gas current that is higher in temperature than the other gas current to the other gas current through the sheet for a total heat exchanger. Also, when moisture permeates from the gas current that is higher in humidity to the other gas current through the sheet for a total heat exchanger, latent heat is also transferred.

Such two different kinds of gas currents may comprise an exhaust gas current discharged from inside to outside of a building, and a supply gas current that is supplied from outside to inside of the building. The element for a total heat exchanger according to the present invention may be an element 14 shown in FIGS. 1(*a*) to 1(*c*). It include the sheet 11 for a total heat exchanger according to this invention, through which moisture 16 (and its latent heat) and sensible heat 15 are transferred between the supply gas current 12 and the exhaust gas current 13, and ventilate the interior of the building while maintaining the heat or cold of the interior of the building.

The total heat exchanger which includes the element 14 for a total heat exchanger that uses the sheet 11 for a total heat exchanger according to the present invention as a partition for separating two different air currents that are different in temperature and/or humidity has a high heat exchange capacity, because the sheet 11 according to this invention is high in moisture permeability, and air is partitioned by the porous sheet only, which is not covered by a thick film, but has a thin film or of which only the pores are filled, so that latent heat can also be efficiently transferred. Further, since the closed portion partitioning air is thin, moisture can more easily permeate through the sheet according to the present invention than conventional sheet for total heat exchangers, so that humidity can be more effectively maintained.

Figure 1B:
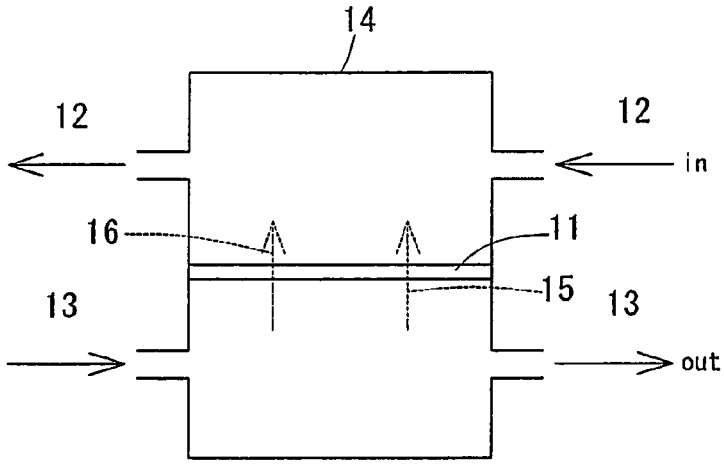
Figure 1C:
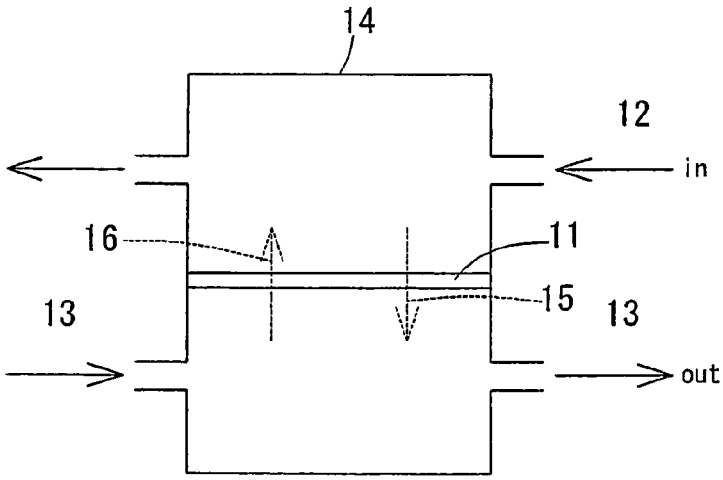
Figure 2:
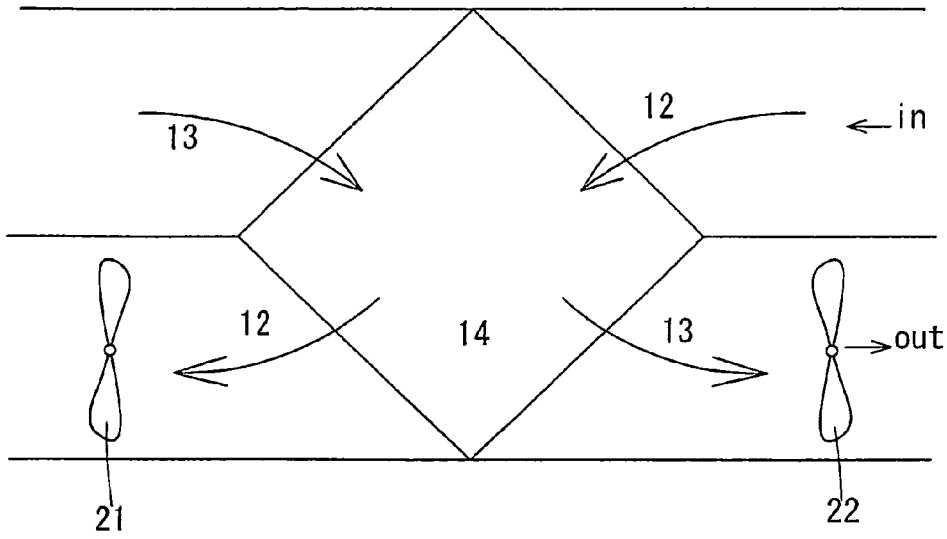
FIG. 2 schematically shows how a total heat exchanger using a sheet for a total heat exchanger according to the present invention is used.

The element 14 for a total heat exchanger shown in FIGS. 1(*a*) to 1(*c*) may be used in a total heat exchanger shown in FIG. 2, in which the element 14 is used in combination with an air supply fan 21 and an exhaust fan 22. Supply gas 12 or outer air is introduced into the total heat exchanger element 14 by the air supply fan 21, and is brought into contact with the total heat exchanger sheet 11 mounted in the total heat exchanger element 14. On the other hand, exhaust gas 13 such as interior air is introduced into the total heat exchanger element 14 by the exhaust fan 22, and similarly brought into contact with the total heat exchanger sheet 11. Between the supply gas 12 and the exhaust gas 13, which are in contact with each other through the total heat exchanger sheet 11, heat exchange occurs in one of the manners shown of FIGS. 1(*a*) to 1(*c*) according to their temperatures and humidities. After heat exchange, the supply gas 12 is introduced e.g. into the interior of a building by the air supply fan 21, while the exhaust gas 13 is discharged e.g. outdoors by the exhaust fan 22. In FIGS. 1 and 2, terms "in" and "out" refer to the directions in which fresh gas is introduced and polluted gas is discharged, respectively.

Of the two kinds of gas currents, the supply gas, which is fresh gas to which heat or cold is imparted, is not necessarily limited to air introduced from outside a building. For example, the present invention may be applicable to a mixture of gases used in laboratories, which has to be kept at a constant temperature and in a predetermined mixture ratio, such as a mixture of nitrogen and oxygen, argon and carbon dioxide which are supplied from respective supply cylinders. Also, air may be introduced into one of two rooms in a building from the other of the two rooms.

Now description is made when the total heat exchanger element 14 according to this invention is mounted between outer air and a building. First, the situation shown in FIG. 1(*a*) is described. FIG. 1(*a*) shows the situation in which the total heat exchanger element 14 is used, as in warm and humid summertime climate, to introduce hot and humid outer air into the building as supply gas 12, and exhaust, as exhaust gas 13, interior cold air cooled by air-conditioning and containing increased amounts of volatile organic compounds and carbon dioxide. In this case, sensible heat 15 is transferred from the supply gas 12 to the exhaust gas 13 through the total heat exchanger sheet 11. Simultaneously, together with the warm moisture 16, latent heat is also transferred. As a result, the supply gas 12 is deprived of heat, so that it is possible to reduce the release of cold obtained by air-conditioning.

Now the situation shown in FIG. 1(*b*) is described. FIG. 1(*b*) shows the situation in which the total heat exchanger element 14 is used in wintertime to introduce cold outer air which contains a smaller amount of moisture into the building as supply gas 12, and exhaust, as exhaust gas 13, interior warm heated air containing increased amounts of volatile organic compounds and carbon dioxide. In this case, sensible heat is transferred from the exhaust gas 13 to the supply gas 12 through the total heat exchanger sheet 11. If the interior warm air contains a large amount of moisture due to the use of a humidifier in addition to the heater or due to the use of a kerosene stove as the heater, moisture 16 is also transferred from the exhaust gas 13 to the supply gas 12 through the total heat exchanger sheet 11, so that latent heat is also transferred. Thus, the supply gas 12 is warmed and its moisture content increases. This reduces the release of both heat and moisture.

Next, the situation shown in FIG. 1(*c*) is described. FIG. 1(*c*) shows the situation in which the total heat exchanger element 14 is used, as in summertime in the desert climate or in the Mediterranean climate, to introduce hot and dry outer air into the building as supply gas 12, and exhaust, as exhaust gas 13, interior air cooled and humidified by air-conditioning. In this case, sensible heat is transferred from the supply gas 12 to the exhaust gas 13 through the total heat exchanger sheet 11. Also, when moisture 16 is transferred from the humid exhaust gas 13 to the dry supply gas 12 through the total heat exchanger sheet 11, cold is transferred from the exhaust gas 13 to the supply gas 12 because the moisture 16 is cold. The supply gas 12 is thus cooled. If the moisture 16 is present in a large amount, due to heat of vaporization when water evaporates on the surface of the total heat exchanger sheet 11 facing the supply gas 12, too, the supply gas 12 is cooled.

By carrying out total heat exchange using a total heat exchanger provided with one or a plurality of the total heat exchanger elements 14 each using one of the total heat exchanger sheets 11 according to the present invention, it is possible to efficiently carry out heat exchange. That is, it is possible to improve the efficiency of the total heat exchanger for exhausting internal air containing increased amounts of volatile organic compounds and carbon dioxide while suppressing the release of heat or cold in the building, thereby maintaining the thermal effect.

Also, because the total heat exchanger sheet 11 is thin, it is possible to reduce the thickness of the total heat exchanger element 14 compared to conventional such elements. Thus it is possible to manufacture a more compact total heat exchanger than conventional total heat exchangers.

Now referring to examples, the present invention is described in detail. Test methods are first described for determining properties necessary for total heat exchanger sheets.

[Test Method for Moisture Permeability]

For each sheet, the moisture permeability per 24 hours ($g/m^2 \cdot 24\ h$) was measured according to the B-2 method under JIS L 1099, with air of 30° C. circulated with the water temperature adjusted to 23° C. The results are shown in Table 1.

[Test Method for Air Permeability]

For each sheet, the air permeability was measured according to a paper pulp test method under standards determined by Japan Technical Association of the Pulp and Paper Industry (JAPAN TAPPI), "Paper and cardboard-smoothness and air permeability test method-Section 2-Oken type", using Oken type air permeability tester KG1-55 made by Asahi Seiko Co., Ltd.

[Thermal Conductivity Test Method]

Each sheet was cut to 100 mm×100 mm, and sandwiched between upper and lower test plates (50 mm×50 mm) which were at 29.9° C. and 22.3° C., respectively in an atmosphere of 20° C. in room temperature and 65% RH in humidity, and the heat flow rate per 60 seconds was measured using a Precise and Prompt Thermal-Property Measuring Instrument: KES-F7 THERMO LABO II, made by Kato Tech Co., Ltd. The thermal conductivity was calculated from the thus measured value.

[Tensile Strength Test Method]

Each sheet was left to stand overnight in an atmosphere of 20° C. in room temperature and 65% RH in humidity to adjust its humidity. Each sheet was then cut to a strip having a width of 15 mm, and its tensile strengths in the longitudinal direction (MD) and the transverse direction were measured using a universal testing machine: UTM-11, made by Toyo Baldwin Co., Ltd.

[Thickness Measuring Method]

After adjusting the humidity of each sheet in the above manner, as the thicknesses of each sheet was measured at ten points thereof, using an automatic micrometer (made by Hi-Bridge Seisakusho), and their average was calculated.

<Forming Sheets for a Total Heat Exchanger>

Now description is made of how respective sheets for a total heat exchanger were formed.

EXAMPLE 1 OF THE INVENTION

On a mixed nonwoven fabric formed by mixing, in equivalent amounts, a layer comprising 100% by weight of rayon pulp as a hydrophilic fiber, and a layer containing 50% by weight of rayon pulp and 50% by weight of polyethylene fiber as a non-hydrophilic fiber (hydrophilic fiber: non-hydrophilic fiber=75% by weight: 25% by weight; made by Nakao Seishi, MPE-5-35, weight: 35 g/m$^2$, thickness: 71.0 μm), a viscose having a cellulose concentration of 4.8% by weight was spread by a roll coater, and the fabric was continuously immersed in an aqueous solution bath of 11% sulfuric acid to regenerate cellulose. Then, after rinsing, the fabric was desulfurized in an aqueous solution bath of a mixture of 0.6% by weight of sodium hydroxide and 0.6% by weight of sodium sulfide, and then bleached in an aqueous solution bath of 0.6% by weight of sodium hypochlorite. The fabric was then sufficiently rinsed and dried to obtain a hydrophilic polymer-processed sheet. The coating amount of cellulose of this sheet based on the weight of the base paper used was 6.3 g/m$^2$, and its thickness was 75.0 μm. This sheet was used as a sheet for a total heat exchanger, and was subjected to the above-described tests. The results are shown in Tables 1 and 2.

TABLE 1

| | Moisture permeability (B-2 under JIS L 1099) (g/m$^2$/24 hr) | Air permeability (Paper pulp test method of JAPAN TAPPI) (Sec/100 cc) | Thermal conductivity (W/(m · K)) |
|---|---|---|---|
| Base paper of Examples 1, 2 and 5 of the invention | 34000 | 10 or less | 0.0226 |
| Example 1 of the invention | 12400 | 30000 or over | 0.0211 |
| Example 2 of the invention | 17700 | 30000 | 0.0183 |
| Base paper of Example 3 of the invention | 59600 | 10 or less | 0.0132 |
| Example 3 of the invention | 30700 | 30000 or over | 0.0101 |
| Base paper of Example 4 of the invention | 28300 | 10 or less | 0.0264 |
| Example 4 of the invention | 16000 | 30000 or over | 0.0284 |
| Example 5 of the invention | 6900 | 10000 | 0.0171 |

TABLE 2

| | Tensile strength (kN/m) | |
|---|---|---|
| | Machine direction (MD) | Transverse direction (TD) |
| Base paper of Examples 1, 2 and 5 of the invention | 1.11 | 0.50 |
| Example 1 of the invention | 2.99 | 1.22 |
| Example 2 of the invention | 2.39 | 0.75 |

Figure 4:
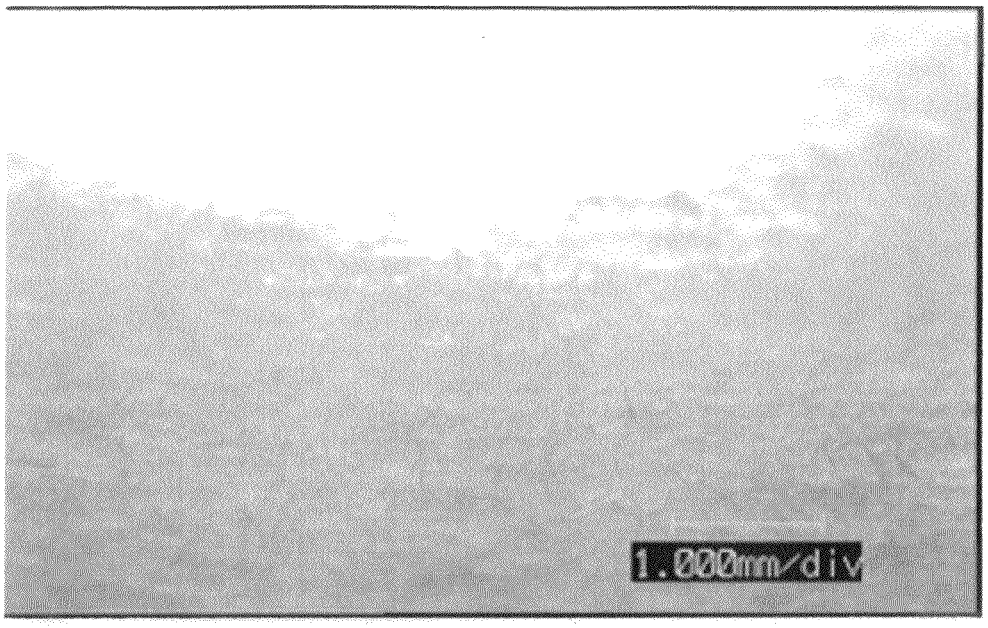
FIG. 4 is a surface photo of a porous sheet according to Example 1 of the invention before a viscose is coated thereon.
Figure 5:
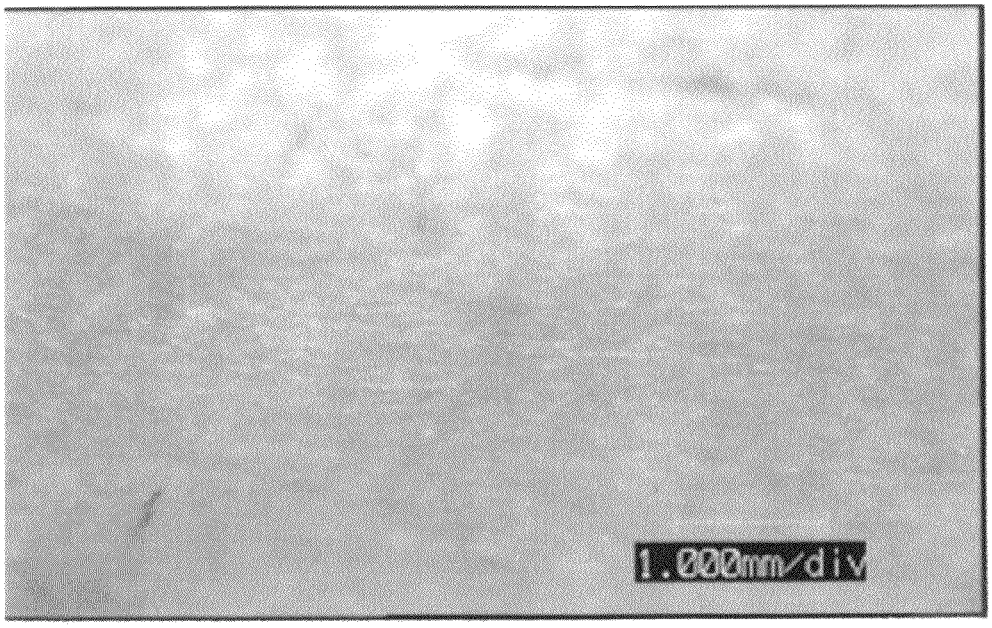
FIG. 5 is a surface photo of the porous sheet according to Example 1 of the invention after a viscose is coated thereon.

FIG. 4 shows an enlarged photo of the surface of this hydrophilic polymer-processed sheet before the viscose is spread thereon, and FIG. 5 shows an enlarged photo of its surface after the viscose has been spread thereon. From these photos, it is apparent that the cellulose generated from the viscose is uniformly distributed over the entire sheet.

Figure 6:
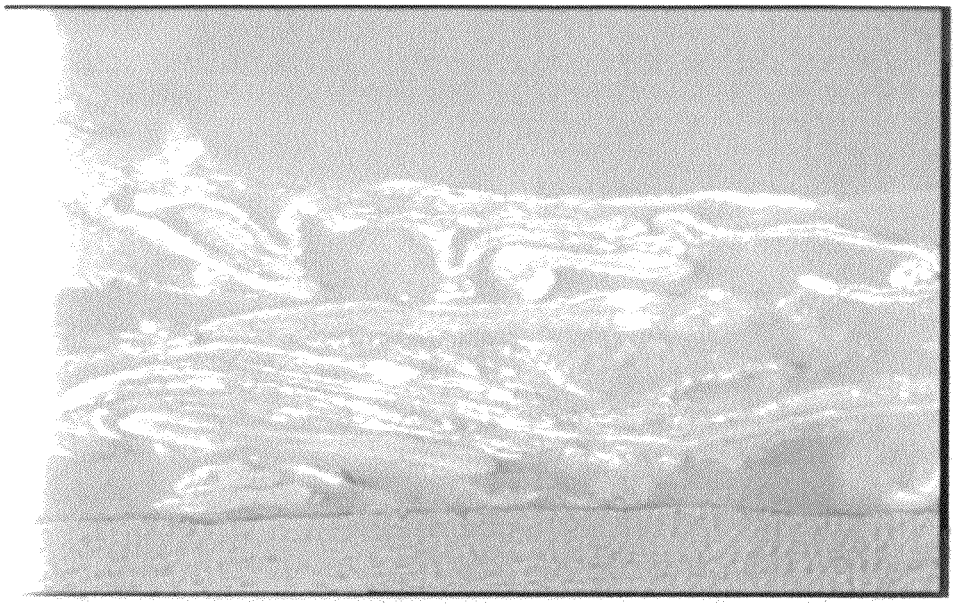
FIG. 6 is an enlarged photo, as taken by a scope, of a section of the porous sheet according to Example 1 of the invention, before being processed with a viscose.
Figure 7:
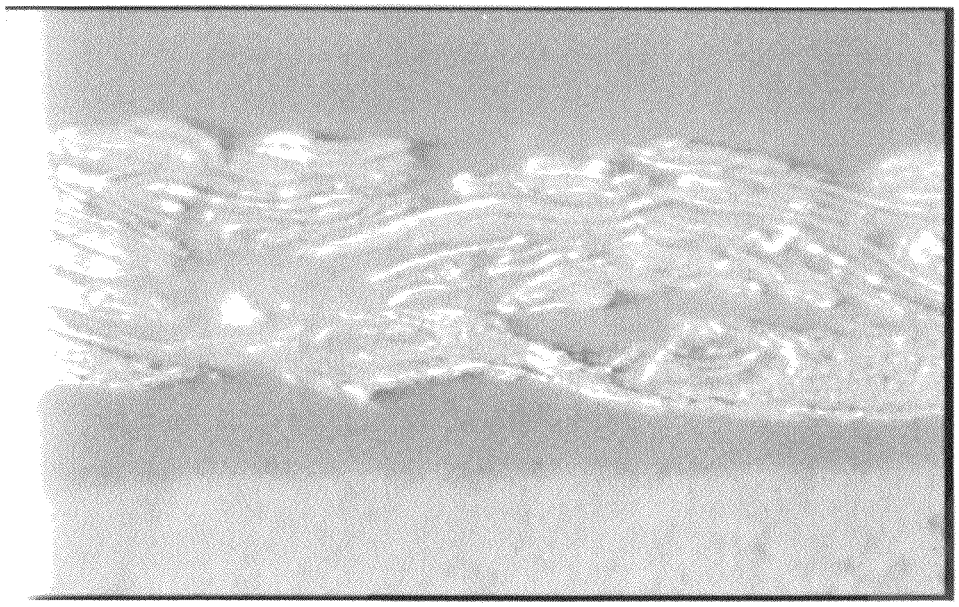
FIG. 7 is an enlarged photo, as taken by a scope, of a section of the porous sheet according to Example 1 of the invention, after being processed with a viscose.

FIG. 6 shows a 1500-power magnification photo of a section of the base paper of this polymer-processed sheet before the viscose is spread, as taken by a scope. FIG. 7 shows a 1500-power magnification photo of a section of a hydrophilic polymer-processed sheet processed with a viscose, as taken by a scope. Here, for easy understanding of the distribution of the hydrophilic polymer, a hydrophilic polymer-processed sheet obtained by mixing a blue pigment (TL-500BLUE-R, made by Dainichiseika Color & Chemicals Mfg. Co., Ltd.) with the viscose is observed as a sample. From these photos, it is apparent that the gaps between fibers present in the original base paper are filled with the cellulose, so that the pores are closed.

Figure 8:
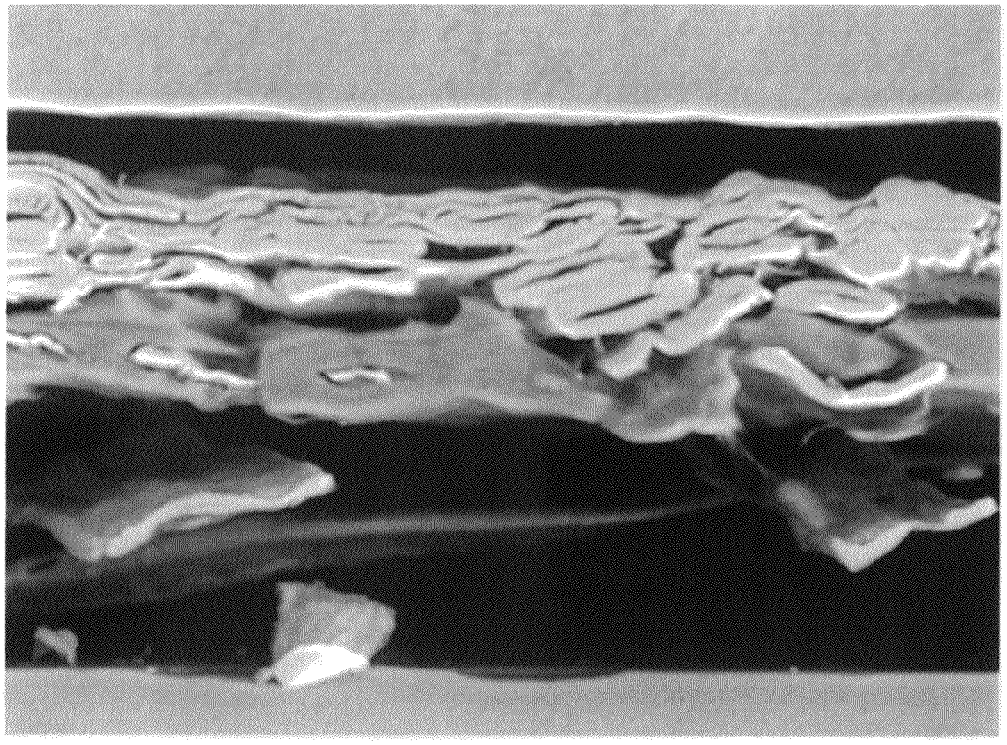
FIG. 8 is an electron microscope photo of a section of the sheet of Example 1 of the invention, after being processed with a viscose.

Further, FIG. 8 shows a photo of a section of this polymer-processed sheet taken by a scanning electron microscope. Here, the hydrophilic polymer-processed sheet is shown as extending from right to left in the middle of the figure. From this figure, it is apparent that the cellulose and the fibers are integrated with each other to such an extent that they are not distinguishable from each other.

EXAMPLE 2 OF THE INVENTION 2.9% by weight of a viscose having a cellulose concentration of 2.9% by weight was spread in the same manner as in Example 1 of the invention, and a hydrophilic polymer-processed sheet of which the coating amount of the cellulose was 3.0 g/m$^2$ was obtained in the same manner as in Example 1 of the invention. Measurement results thereof are shown in Tables 1 and 2.

EXAMPLE 3 OF THE INVENTION

On mixed paper comprising wood pulp and Manila hemp and thus comprising 100% of hydrophilic fiber (Cake Cardboard A, made by Nippon Daishowa Paperboard Co., Ltd., weight: 20 g/m$^2$, thickness: 41.2 μm), a viscose having a cellulose concentration of 7.5% by weight was spread in the same manner as in Example 1 of the invention, and the paper was treated in the same manner as in Example 1 of the invention to obtain a hydrophilic polymer-processed sheet of which the coating amount of cellulose is 11.2 g/m$^2$ and having a thickness of 50.9 μm. Measurement results thereof are shown in Table 1.

EXAMPLE 4 OF THE INVENTION

On one-side-polished kraft paper having one side thereof calendered and containing 100% of wood pulp as a hydrophilic fiber (OP, made by Shiroyama Seishi, weight: 65 g/m$^2$, thickness: 91.3 μm), a viscose having a cellulose concentration of 4.8% by weight was spread in the same manner as in Example 1 of the invention, and the paper was processed in the same manner as in Example 1 of the invention to obtain a hydrophilic polymer-processed sheet of which the coating amount of cellulose is 2.2 g/m2 and which has a thickness of 94.0 μm. Measurement results thereof are shown in Table 1.

COMPARATIVE EXAMPLE 1

On a nonwoven fabric made of composite fiber, as a hydrophilic fiber, which comprises a core of polyethylene terephthalate, and a polyethylene layer covering the core (ELVES, made by Unitika, Ltd., thickness: 104.5 μm). a viscose having a cellulose concentration of 4.8% by weight was spread in the same manner as in Example 1 of the invention, the cellulose was solidified and regenerated in the same acidic bath of sulfuric acid, and the fabric was desulfurized and bleached to obtain a sheet of which the cellulose film is peeled off.

Figure 9:
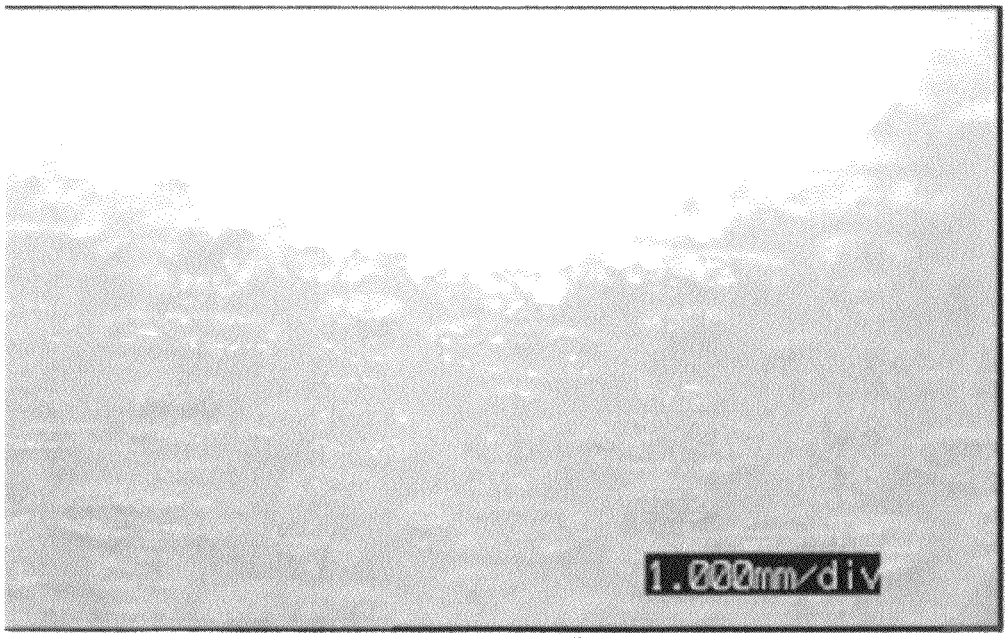
FIG. 9 is a surface photo of a porous sheet according to Comparative Example 1 before a viscose is coated thereon.
Figure 10:
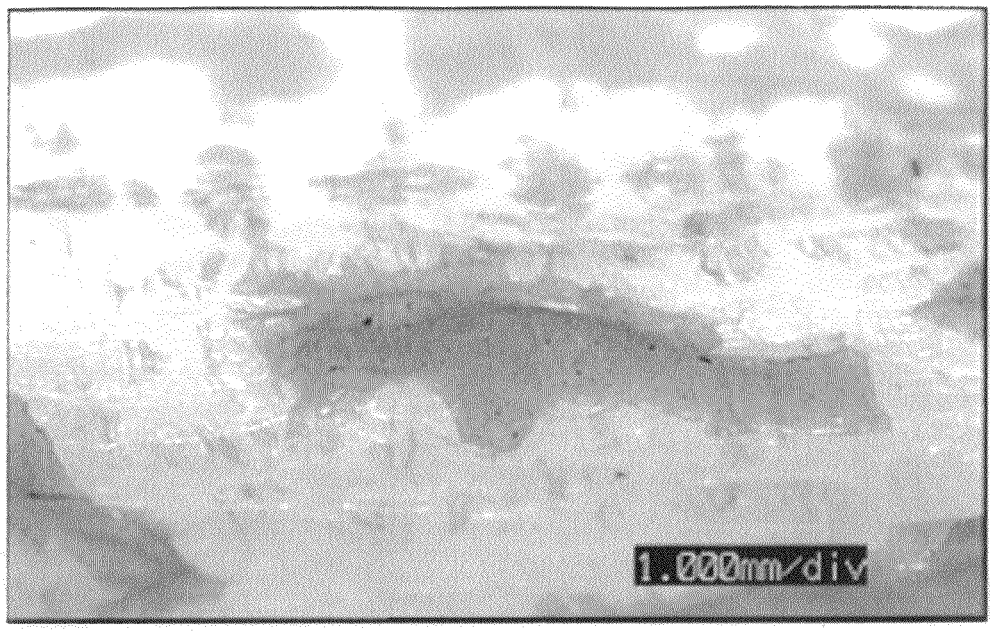
FIG. 10 is a surface photo of the porous sheet according to Comparative Example 1 after a viscose is coated thereon.

FIG. 9 shows a surface photo of the porous sheet of Comparative Example 1 before the viscose is spread. FIG. 10 shows the hydrophilic polymer-processed sheet of Comparative Example 1 after the sheet has been processed with the viscose. The viscose is not uniformly spread on the surface but forms islands covering only portions of the surface, so that the viscose cannot completely close the pores of the porous sheet.

Figure 11:
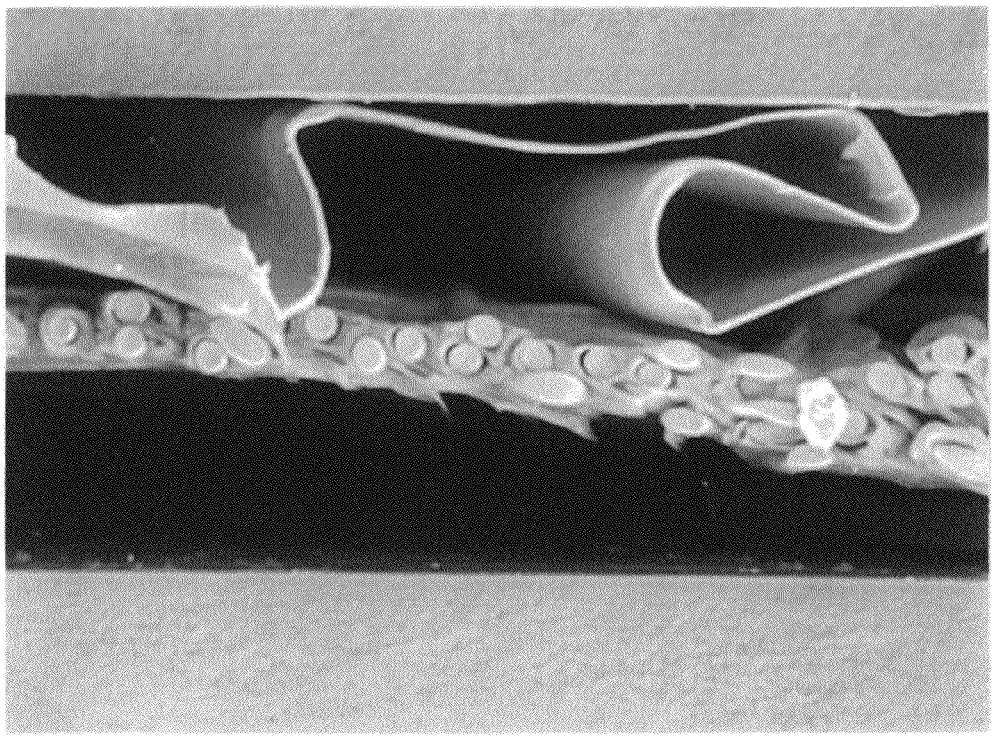
FIG. 11 is an electron microscope photo of a porous sheet of Comparative Example 1 after a viscose is coated thereon.

FIG. 11 shows an electron microscope photo of a section of the sheet of Comparative Example 1. The fibers shown in the middle of this photo are cores of the polyethylene terephthalate fibers, which are surrounded by polyethylene fibers. Over these fibers, a cellulose film is shown which is peeled off the fibers and folded.

EXAMPLE 5 OF THE INVENTION

Instead of the viscose used in Example 1 of the invention, an aqueous solution of a mixture of 95 parts of a 15% by weight aqueous solution of polyvinyl alcohol having carbonyl groups (DF-17 made by Japan Vam & Poval Co., Ltd.) and 5 parts of a 10% by weight aqueous solution of adipic acid dihydrazide as a crosslinking agent was spread with a roll coater, and the solution was heated and dried at 100° C. for 30 minutes to react it with the crosslinking agent, thereby obtaining a hydrophilic polymer-processed sheet of which the coating amount of polyvinyl alcohol is 14.7 g/m$^2$ and which has a thickness of 93.6 μm. Measurement results thereof are shown in Table 1.

EXAMPLE 6 OF THE INVENTION

The hydrophilic polymer-processed sheet obtained in Example 1 of the invention was immersed in a 20% by weight aqueous solution of a guanidine sulfamate fire retardant (Apinon-101 made by Sanwa Chemical Co., Ltd.), and dried to obtain a fireproof hydrophilic polymer-processed sheet containing 22.9% of the fire retardant. The sheet was subjected to a fireproof test according to "Test Method for Fire Retardancy of Thin Construction Materials" under JIS A 1322 to observe the char length, after flame and afterglow. As a result, the sheet was determined to clear the Fireproof Level 2.

EXAMPLE 7 OF THE INVENTION

Waterproof Treatment

When forming a hydrophilic polymer-processed sheet in the same manner as in Example 1 of the invention, before drying, the sheet was immersed in a solution obtained by diluting a wax emulsion water repellant (Johnwax made by Johnson Polymer, solid content: 25% by weight) with water so that the solid content is 5% by weight, and dried by squeezing with a press roller, thereby obtaining a waterproof hydrophilic polymer-processed sheet having the water repellant deposited by 1.2 g/m$^2$. For this sheet and the sheet of Example 1 of the invention, a water repellency test was conducted according to a test method of JAPAN TAPPI, "Paper and cardboard-water repellency test method", in which the water repellency was determined under the standards of Table 3 by sticking the respective test pieces on an inclined plate, and flowing down water drops along the test pieces to observe the flow marks thereon. The sheet of Example 7 was determined to be R4, while the sheet of Example 1 was determined to be R0. Because the hydrophilic polymer-processed sheet is being formed, it is difficult to carry a large amount of water-resistant additives. But the water repellency of R4 was obtained with a small amount of such additives.

TABLE 3

| Water repellency | |
|---|---|
| R0 | Continuous flow mark with uniform width |
| R2 | Continuous flow mark with a width narrower than water drops |
| R4 | Substantially continuous but partially discontinuous flow mark with a width clearly narrower than water drops |
| R6 | Half the flow mark is wet |
| R7 | ¼ of the flow mark is wet with elongated water drops |
| R8 | Not less than ¼ of the flow mark is scattered with spherical water drops |
| R9 | Scattered with small spherical droplets |
| R10 | Every water drop rolls down the surface |

EXAMPLE 8 OF THE INVENTION

A hydrophilic polymer-processed sheet of which the coating amount of cellulose is 2.5 g/m$^2$ and which has a thickness of 52 μm was formed in the same manner as in Example 4 of the invention, except that one-side-polished kraft paper that is thinner than the one used in Example 4 (OP, made by Shiroyama Seishi, weight: 35 g/m$^2$, thickness: 53 μm) was used. For this hydrophilic polymer-processed sheet, the moisture permeability and air permeability were measured in the same manner as in Example 4 of the invention, and also the same fire retardancy test as in Example 6 of the invention was conducted. The results are shown in Table 4. Measurements results for the base paper before being processed are also shown in Table 4.

TABLE 4

| | Moisture permeability (B-2 under JIS L 1099) ($g/m^2/24$ h) | Air permeability (Paper pulp test method of JAPAN TAPPI) (Sec/100 cc) | Fire retardancy (under JIS A 1322) |
|---|---|---|---|
| Example 8 of the invention | 26000 | 15000 | None |
| Example 9 of the invention | 49000 | 30000 | Fireproof Level 2 |
| Example 10 of the invention | 100000 | 30000 | Fireproof Level 2 |
| Base paper of Examples 8-10 of the invention | 34000 | 5 or less | None |

EXAMPLE 9

Fire-Retardant Treatment

The hydrophilic polymer-processed sheet obtained in Example 8 of the invention was immersed in a 20% by weight aqueous solution of a mixture of ammonium phosphate and ammonium sulfamate (NICCAFI-NONE 900, made by Nicca Chemical Co., Ltd.), squeezed with a mangle, and dried to obtain a fireproof hydrophilic polymer-processed sheet containing 9.6% by weight of the fire retardant. The results of measurement thereof carried out in the same manner as in Example 8 of the invention are shown in Table 4.

EXAMPLE 10 OF THE INVENTION

Hygroscopic Treatment

The hydrophilic polymer-processed sheet obtained in Example 8 of the invention was immersed in a 20% by weight aqueous solution of lithium chloride (made by Honjo Chemical Corp.), squeezed with a mangle, and dried to obtain a hygroscopic hydrophilic polymer-processed sheet containing 12.4% by weight of the moisture absorbent. The results of measurement thereof carried out in the same manner as in Example 8 of the invention are shown in Table 4.

EXAMPLE 11 OF THE INVENTION

Instead of the viscose used in Example 1 of the invention, a slurry comprising a 100:5 (weight ratio) mixture of a viscose having a cellulose concentration of 9.1% (made by Rengo Co., Ltd.) and aluminum hydroxide powder (BF013 made by Nippon Light Metal Co., Ltd.) was spread on a pulp-hemp mixed nonwoven fabric (FB-18, made by Nippon Daishowa Paperboard Co., Ltd., weight: 18 $g/m^2$, thickness: 51 μm), and processed in the same manner as in Example 1 of the invention to obtain a fireproof hydrophilic polymer-processed sheet of which the coating amount of cellulose is 11 $g/m^2$ and the coating amount of aluminum hydroxide is 6 $g/m^2$. Its fire retardancy was measured under JIS A 1322 in the same manner as in Example 6 of the invention and determined to clear the Fireproof Level 2.

EXAMPLE 12 OF THE INVENTION

An 8% by weight aqueous solution of polyvinyl alcohol (PVA-117 (complete saponification), made by Kuraray Co., Ltd.) was spread on one-side-polished kraft paper (OP, made by Shiroyama Seishi, weight: 35 $g/m^2$, thickness: 53 μm) with a roll coater, and dried to obtain a hydrophilic polymer-processed sheet of which the coating amount of polyvinyl alcohol is 2.7 $g/m^2$, and which has an air permeability of 15,000 seconds/100 cc, and a moisture permeability of 20,000 $g/m^2/24$ hours.

EXAMPLE 13 OF THE INVENTION

A 15% by weight aqueous solution of polyvinyl alcohol having a saponification degree of 88% (GOHSELAN L-3266, made by Nippon Synthetic Chemical Industry Co., Ltd.) was spread on the one-side-polished kraft paper used in Example 12 of the invention with a roll coater, and after drying, the paper was immersed in a 20% aqueous solution of lithium chloride, and dried to obtain a hydrophilic polymer-processed sheet of which the coating amount of polyvinyl alcohol is 11 $g/m^2$, and the content of the moisture absorbent is 10.8% by weight, and which has an air permeability of 30,000 seconds/100 cc, and a moisture permeability of 48,000 $g/m^2/24$ hours.

EXAMPLE 14 OF THE INVENTION

Figure 3:
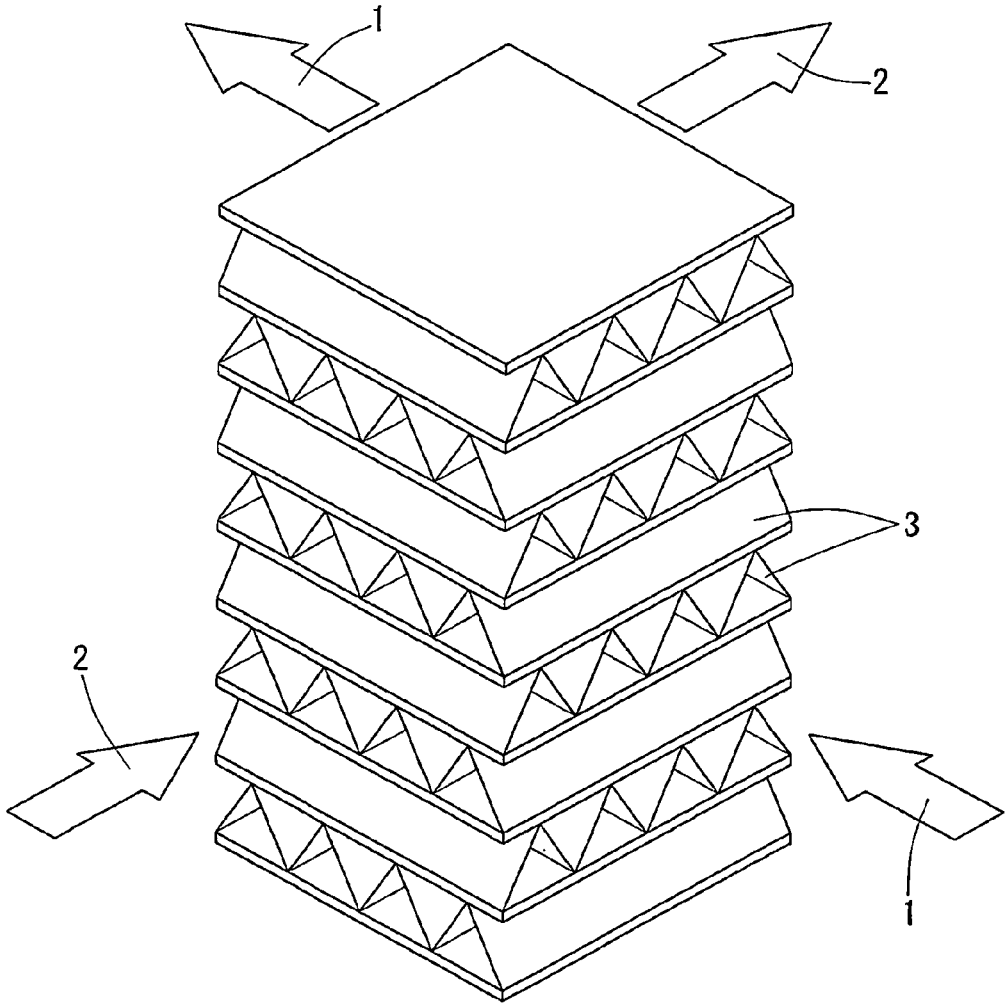
FIG. 3 is a schematic view of a conventional static total heat exchanger.

The hydrophilic polymer-processed sheet obtained in Example 9 of the invention was laminated on corrugated one-side-polished kraft paper (OP, made by Shiroyama Seishi, weight: 65 $g/m^2$) to form a static total heat exchanger shown FIG. 3 (190 mm×190 mm×350 mm, 134 tiers). The total heat exchange rate of this heat exchanger as measured under JIS B 8628 was 74%.

EXAMPLE 15 OF THE INVENTION

A static total heat exchanger was formed in the same manner as in Example 14 of the invention, except that the hydrophilic polymer-processed sheet obtained in Example 10 of the invention. Its total heat exchange rate was 82%.

What is claimed is:

1. A sheet for use in a total heat exchanger comprising a hydrophilic polymer-processed sheet, said hydrophilic polymer-processed sheet comprising a porous sheet containing not less than 30% by weight and not more than 100% by weight of hydrophilic fiber and a fire retardant, and having pores thereof closed with regenerated cellulose, wherein said porous sheet is coated with an aqueous solution of cellulose which is a viscose, the pores of said porous sheet are closed with cellulose regenerated from said aqueous solution of cellulose on the surface and/or inside of said porous sheet, the cellulose regenerated from the aqueous solution of cellulose is present on the sheet in an amount of not less than 0.5 $g/m^2$ and not more than 30 $g/m^2$, and the sheet has a moisture permeation of not less than 10000 $g/m^2$ per 24 hours, as measured according to a B-2 method of Moisture Permeability of Fiber materials under JIS L 1099, with air of 30° C. circulated with water temperature adjusted to 23° C.

2. An element for use in a total heat exchanger wherein the sheet for use in a total heat exchanger as claimed in claim 1 is used as a separator for separating two kinds of gas currents that are different in temperature and/or humidity from each other.

3. A total heat exchanger using the element for use in a total heat exchanger as claimed in claim 2.

4. The sheet for use in a total heat exchanger according to claim 1, wherein the hydrophilic polymer-processed sheet further comprises a water-resistant agent and/or a moisture absorbent.

* * * * *